US005445285A

United States Patent [19]

Sugawara et al.

[11] Patent Number: 5,445,285

[45] Date of Patent: Aug. 29, 1995

[54] GLASS BULB FOR A CATHODE RAY TUBE

[75] Inventors: Tsunehiko Sugawara, Osaka; Toshihide Murakami, Funabashi; Yusuke Kobayashi, Fuanbashi, all of Japan

[73] Assignee: Asahi Glass Company Ltd., Tokyo, Japan

[21] Appl. No.: 268,792

[22] Filed: Jun. 30, 1994

[30] Foreign Application Priority Data

Jun. 30, 1993 [JP] Japan ..... 5-187268

[51] Int. Cl.[6] ..... H01J 29/86

[52] U.S. Cl. ..... 220/2.1 A; 313/477 R

[58] Field of Search ..... 220/2.1 A, 2.3 A; 313/477 R, 480

[56] References Cited

U.S. PATENT DOCUMENTS 3,163,794 12/1964 Bloomsburgh et al. ... 313/477 A X
3,835,250 9/1974 Kaljuko et al. ..... 220/2.1 A X
4,566,893 1/1986 Hopkins et al. .
5,138,461 8/1992 Kawamura et al. ..... 220/2.1 A X
5,155,410 10/1992 Wakasono et al. ..... 313/477 R X
5,188,553 2/1993 Dougherty ..... 220/2.1 A X
5,304,890 4/1994 Tsukui et al. ..... 220/2.1 A X
5,355,051 10/1994 Fondrk ..... 220/2.3 A X

*Primary Examiner*—Steven M. Pollard
*Attorney, Agent, or Firm*—Oblon, Spivak, McClelland, Maier & Neustadt

[57] ABSTRACT

A glass bulb for a cathode ray tube having a thinner wall thickness to reduce the weight while there is little possibility of causing an implosion.

A compression layer having a compressive stress $\sigma_{KC}$ is formed in a region of a panel portion 3 by physically strengthen the portion. The relation among the compressive stress $\sigma_{KC}$, the breaking stress $\sigma_{SG}$ of the glass bulb and the maximum value $\sigma_{VTmax}$ of a tensile strength is $1<3\sigma_{VTmax}/\sigma_{SG}\leqq 1-(\sigma_{KC}/\sigma_{SG})\leqq 1.60$.

29 Claims, 2 Drawing Sheets

GLASS BULB FOR A CATHODE RAY TUBE

BACKGROUND OF THE INVENTION

1. Field of the Invention

The present invention relates to a cathode ray tube having a glass bulb which is mainly used for TVs.

2. Discussion of Background

As shown in FIG. 1, a cathode ray tube 1 for TVs comprises a glass bulb 2 which is basically constituted by a panel portion 3 for displaying a picture image, a funnel portion 4 on which a deflection coil is mounted and a neck portion 5 for receiving an electron gun 17.

In FIG. 1, reference numeral 6 designates a panel skirt portion, numeral 7 designates a panel face portion for displaying a picture image, numeral 8 designates an implosion-proof reinforcing band for providing strength, numeral 10 designates a sealing portion at which the panel portion 3 and the funnel portion 4 are sealed with solder glass or the like, numeral 12 designates a fluorescent film for emitting light by the excitation of irradiated electron beams, numeral 13 designates an aluminum film for reflecting light to the outside of a screen, numeral 14 designates a shadow mask for defining the position of irradiation of electron beams, numeral 15 designates a stud pin for fixing the shadow mask 14 to the inside surface of the panel skirt portion 6, and numeral 16 designates a inner conductive coating which prevents the shadow mask 14 from being charged by the electron beams and which leads electric charges to the outside. A symbol A indicates a tube axis which connects the center axis of the neck portion 5 and the center of the panel portion 3.

Since an atmospheric pressure is applied to the outer surface of the glass bulb for a cathode ray tube, which is used as a vacuum vessel, a stress (hereinbelow, referred to as a vacuum stress) is produced. The glass bulb has an asymmetric shape unlike a spherical shape, and accordingly, there are a region of tensile stress (a sign of +) and a region of compressive stress (a sign of −) in a relatively broad area on the glass bulb surface as shown in FIG. 2. In FIG. 2, a symbol $\sigma_R$ represents a component of stress along the paper surface and a symbol $\sigma_T$ represents a component of stress perpendicular to the paper surface. The numerical values described near the distribution lines of stress represent the values of stress at these positions.

There is a two-dimensional distribution of stress in the front surface of the glass bulb. Generally, the maximum value of tensile vacuum stress exists in an edge portion of a picture image displaying portion of the panel face portion or a side wall portion of the panel glass. Accordingly, if the tensile vacuum stress produced on the glass bulb surface is large and the glass bulb does not have a sufficient strength in structure, there may result a static fatigue breakage due to an atmospheric pressure and the glass bulb will not function as a cathode ray tube.

Further, in manufacturing the cathode ray tube, the glass bulb is kept at a high temperature such as about 380° C. and air inside the glass bulb is evacuated. During such heating process, a thermal stress is resulted in addition to the vacuum stress. In this case, an intensive implosion is resulted due to an instantaneous introduction of air and the reaction thereof, which may damage the neighborhood.

As a guarantee to prevent such breakage of glass bulb, an external pressure loading test has been conducted. In consideration of the depth of scratches (or bruises) which may result in the surface of the glass bulb during the assembling of the cathode ray tube and the service life of it, scratches are formed uniformly in the front surface of the glass bulb by means of abrasion with a #150 emery paper, and a pneumatic pressure or a hydraulic pressure is gradually applied to the glass bulb until it causes breakage of the bulb. Then, the difference of pressure between the inside and outside of the glass bulb is measured. Generally, the glass bulb is required to have a fracture strength durable to at least 3 atm. pressure.

The fracture strength of the glass bulb with scratches is not always primarily determined because a vacuum stress in the outer surface of the glass bulb depends on the structure of it and has a two dimensional distribution as shown in FIG. 2.

FIG. 3 shows the fracture strength of various types of glass bulbs for TVs, which are made of the same material. As shown in FIG. 3, the fracture strength is 190 kg/cm$^2$ in minimum value and about 250 kg/cm$^2$ in average.

On the other hand, in considering the fatigue breakage of the glass bulb due to a vacuum stress, there is a high possibility of the breaking of the glass bulb from a region having the maximum tensile vacuum stress $\sigma_{VTmax}$. Accordingly, in order to obtain a glass bulb for a cathode ray tube having a strength of more than 3 atm. in pressure difference between the inside and the outside of the glass bulb, which is a value for the guarantee of the pressure resistance strength, the condition of 3.0 $\sigma_{VTmax} < \sigma_{SG}$ should be satisfied since the linear characteristics of a elastic material can be applied to the glass bulb. Namely, since $\sigma_{VTmax} < \sigma_{SG}/3$, the geometric structure such as the wall thickness, the shape and so on of the glass bulb is determined so that the maximum tensile vacuum stress $\sigma_{VTmax}$ is in a range of 60 kg/cm$^2$–90 kg/cm$^2$ as shown in FIG. 2.

However, when the glass bulb is formed so that the maximum tensile vacuum stress $\sigma_{VTmax}$ is in a range of 60 kg/cm$^2$–90 kg/cm$^2$, which guarantees the pressure resistance strength of the glass bulb, there is the disadvantage as follows. For instance, the weight of a panel portion for the glass bulb for a color TV cathode ray tube having an effective picture displaying surface of an aspect ratio of 4:3 (lateral direction: the longitudinal direction) is increased in proportion to a power of about 2.0–2.4 of the maximum outer dimension. Accordingly, productivity in a large-sized cathode ray tube, in particular productivity of glass bulbs is extremely reduced, and the cost of materials for the glass bulb is substantially increased.

In order to eliminate such problem, it can be considered to obtain a light-weight glass bulb by, for instance, subjecting the front surface of the glass bulb to an ion exchange treatment to thereby strengthen it. In this method, alkali ions in the glass bulb are replaced by ions larger than the alkali ions at a temperature lower than the slow cooling point of glass whereby a compressive stress is produced in the front surface of the glass bulb owing to an increased volume. For instance, such compressive stress can be obtained by immersing a $SiO_2$—SrO—BaO—$Al_2O_3$—$ZnO_2$ series panel glass containing 5%–8% of $Na_2O$ and 5%–9% of $K_2O$ (5001 type glass manufactured by Asahi Glass Company Ltd.) in a melt of $KNO_3$ kept at about 450° C. for about 4–6 hrs.

With such treatment, a compression layer having a magnitude of about 1500 kg/cm$^2$–3000 kg/cm$^2$ and a depth of about 10 μm–30 μm is formed in the front surface of the panel glass. In this strengthening method, although a layer having a large tensile stress is not formed in the glass bulb, the thickness of a compressive stress layer obtained is thin. Namely, the thickness is equal to or smaller than the depth of the scratches formed by the #150 emery paper shown in Table 1. Accordingly, a scratch penetrating the stress layer may be formed during manufacturing steps or use. In this case, the advantage of the strengthening of the panel face portion is lost.

Further, it is known to strengthen the front surface of the panel glass by using an air tempering method. In the air tempering method, the panel glass is heated to a temperature slightly lower than the glass softening point, and then, air is blasted to rapidly cool the panel glass, whereby a compressive stress layer of about 500 kg/cm$^2$–1000 kg/cm$^2$ is formed in the front surface of the panel glass. In this method, the panel glass is slightly deformed after the rapid cooling treatment because the panel glass is maintained to a temperature region where glass is just softened and the surface of the glass is rapidly cooled. Accordingly, there is a problem of strengthening the panel glass for a cathode ray tube because it must have accurate dimensions. Further, a tensile stress layer is formed in the glass panel at the same time of the formation of the compression layer wherein the magnitude of the tensile stress is half as much as the absolute value of the compressive stress. Therefore, when a crack develops inside the panel glass, the panel glass implodes itself to release energy of the stored tensile stress. Accordingly, when a large tensile stress is formed in the glass bulb as a vacuum vessel of a cathode ray tube, there is a problem of an implosion.

SUMMARY OF THE INVENTION

It is an object of the present invention to provide a glass bulb for a cathode ray tube having a strengthened front surface of the glass bulb while maintaining safety and being free from the implosion of the cathode ray tube, and reducing the weight by improving a relation of a strengthened compressive stress, a tensile vacuum stress in the glass bulb and the fracture strength of the glass bulb.

According to the present invention, there is provided a glass bulb for a cathode ray tube which comprises a panel portion having a substantially rectangular panel face portion; a funnel portion, and a neck portion, wherein a physically strengthened compression layer having a compressive stress $\sigma_{KC}$ is formed in at least the panel portion of the glass bulb, and the compressive stress $\sigma_{KC}$ has a relation of $1<3\sigma_{VTmax}/\sigma_{SG}\leqq 1-(\sigma_{KC}/\sigma_{SG})\leqq 1.60$ to the fracture strength $\sigma_{SG}$ of the glass bulb and the maximum tensile vacuum stress $\sigma_{VTmax}$ which is the maximum value of tensile stress generated in the surface of the glass bulb vacuumed onto which an atmospheric pressure is applied.

In the present invention, when the absolute value of the compressive stress $\sigma_{KC}$ is excessively large, an implosion is apt to occur. Accordingly, it is preferable to be $1<3\sigma_{VTmax}/\sigma_{SG}\leqq 1-(\sigma_{KC}/\sigma_{SG})\leqq 1.50$. Specifically, the compressive stress $\sigma_{KC}$ should be $-150$ to $-30$ kg/cm$^2$. When the absolute value of the compressive stress $\sigma_{KC}$ is larger than 150 kg/cm$^2$, an implosion is apt to occur. On the other hand, when the absolute value is smaller than 30 kg/cm$^2$ the strengthening effect to the glass bulb is insufficient.

The maximum value of tensile stress $\sigma_{VTmax}$ is in a range of 70–100 kg/cm$^2$, which is determined from the structure of the glass bulb. Accordingly, the maximum value $\sigma_{VTmax}$ can be determined to be a value equal to or larger than the value conventionally used.

It is desirable that the compressive stress $\sigma_{KC}$ has a larger value in the panel face portion rather than the skirt portion of the panel portion. When the compressive stress $\sigma_{KC}$ has a larger value in the panel face portion, deformation in shape of the panel glass due to the twisting after a cooling treatment can be fairly prevented. In this case, it is preferable that the compressive stress of the skirt portion is in a range of from 50% to less than 100% of the compressive stress of the panel face portion. More preferably, the compressive stress of the skirt portion is in a range of from 60% to 90% of the compressive stress of the panel face portion. When it is smaller than 50%, the strengthening effect to the skirt portion is insufficient. In this case, it is necessary to increase the wall thickness of the skirt portion, with the result of difficulty in reducing the weight of the glass bulb.

The panel portion in which the compressive stress of the panel face portion is larger than the compressive stress of the skirt portion is produced by rapidly cooling in comparison with the skirt portion of the panel portion, for instance by supplying cooling air mainly to the panel face portion until the temperature of the glass bulb decreases to a distortion point. Thus, the panel face portion is rapidly cooled whereby a large compressive stress is formed in the panel face portion.

Further, according to the present invention, there is provided a glass bulb for a cathode ray tube which comprises a panel portion having a substantially rectangular panel face portion; a funnel portion, and a neck portion, wherein a physically strengthened compression layer having a compressive stress $\sigma_{KC}$ is formed in at least the panel portion of the glass bulb, and the compressive stress $\sigma_{KC}$ has a relation of $1<3\sigma_{VTmax}/\sigma_{SG}\leqq 1-(\sigma_{KC}/\sigma_{SG})$ and $-150$ kg/cm$^2\leqq\sigma_{KC}-30$ kg/cm$^2$ to the fracture strength $\sigma_{SG}$ of the glass bulb and the maximum tensile vacuum stress $\sigma_{VTmax}$ which is the maximum value of tensile stress generated in the surface of the glass bulb vacuumed onto which an atmospheric pressure is applied.

Further, according to the present invention, there is provided a glass bulb for a cathode ray tube which comprises a panel portion having a substantially rectangular panel face portion; a funnel portion, and a neck portion, wherein a physically strengthened compression layer having a compressive stress $\sigma_{KC}$ is formed in a portion where the maximum vacuum stress is produced, in the panel portion of the glass bulb, and the compressive stress $\sigma_{KC}$ has a relation of $1<3\sigma_{VTmax}/\sigma_{SG}\leqq 1-(\sigma_{KC}/\sigma_{SG})\leqq 1.60$ to the fracture strength $\sigma_{SG}$ of the glass bulb and the maximum tensile vacuum stress $\sigma_{VTmax}$ which is the maximum value of tensile stress generated in the surface of the glass bulb vacuumed onto which an atmospheric pressure is applied.

In the present invention, when the maximum tensile vacuum stress is produced in an outer surface of the panel face portion, the compressive stress of the panel face portion should be larger than the compressive stress of the skirt portion of the panel portion from the viewpoint that the development of a crack resulted in the front surface of the glass bulb due to the maximum tensile vacuum stress can be prevented; hence preventing an implosion. In this case, the compressive stress of the skirt portion should be from 50% but less than 100% of the compressive stress of the panel portion. When the compressive stress of the skirt portion is larger than that of the panel face portion, it is impossible to prevent the deformation of the panel glass due to the twisting after a cooling treatment has been conducted. Further, when the compressive stress of the skirt portion is less than 50% of the compressive stress of the panel face portion, the strengthening effect to the skirt portion is insufficient. In this case, it is necessary to increase the wall thickness of the skirt portion. However, the purpose of reducing the weight of the glass bulb can not be attained.

Further, in the glass bulb for a cathode ray tube wherein the maximum tensile vacuum stress $\sigma_{VTmax}$ exists in an edge portion of a picture image displaying surface of the panel portion, there should be a relation of $\sigma_{SG}/(\sigma_{SG}-\sigma_{KC})\leqq(t_1/t_0)^2<1$ where $t_1$ is the wall thickness of the central portion of the panel face portion and $t_0$ is the wall thickness of the central portion of the panel face portion under the condition that when the shapes of the inside and the outside of the panel face portion are constant and the wall thickness of the panel face portion is changed to be $\sigma_{VTmax}=\sigma_{SG}/3$.

Desirably the value $(t_1/t_0)^2$ is in a range of $0.64\leqq(t_1/t_0)^2<1$. When it is smaller than 0.64, the wall thickness of the panel face portion is thin whereby the implosion is apt to occur. When $t_1=t_0$, it is impossible to reduce the wall thickness of the panel face portion so that the weight of the glass bulb is reduced.

The feature of the present invention is to form a compression layer by a physically strengthening method in the front surface of a glass bulb for a cathode ray tube comprising a panel portion, a funnel portion and a neck portion wherein the compression layer is formed to have a surface area and a thickness so as not to cause the implosion of the cathode ray tube (in the specification, a tensile stress is expressed by a positive value and a compressive stress is expressed by a negative value). In the present invention, an admissible range of the maximum tensile vacuum stress $\sigma_{VTmax}$, which is determined by mechanical properties of the glass bulb and the structure of the glass bulb in a relation to the compressive stress by strengthening $\sigma_{KC}$, is increased in comparison with the conventional glass bulb whereby the glass bulb having a light weight can be provided.

In a preferred embodiment of the present invention, the relation of the absolute value of the compressive stress $\sigma_{KC}$ to the fracture strength $\sigma_{SG}$ which is essential with respect to the structure of the glass bulb is $|\sigma_{KC}|\sigma_{SG}/2$, and the maximum value of tensile vacuum stress $\sigma_{VTmax}$ which is determined from the structure of the glass bulb is $\sigma_{SG}/3<\sigma_{VTmax}<(\sigma_{SG}-\sigma_{KC})/3$.

Further, in the present invention, the maximum value of tensile stress $\sigma_{VTmax}$ exists in an edge portion on a shorter axis or a longer axis of an effective picture displaying portion of the outer surface of the panel face portion having a substantially rectangular shape. Further, the compressive stress $\sigma_{KC}$ of the panel face portion is preferably larger than that of a side wall portion of the panel portion. It is because the compressive stress layer is formed by cooling the panel face portion faster than a side wall portion (the skirt portion) of the glass panel, so that the deformation of the panel face portion due to the shrinkage and the solidification of the side wall portion is minimized, whereby accuracy in the radius of curvature of the inner wall portion of the panel face portion can be increased.

When the skirt portion is cooled faster than the panel face portion, a large deformation is resulted in the panel face portion with the shrinkage of the skirt portion. This reduces the accuracy of the radius of curvature of the inner wall portion of the panel face. When a color TV with such glass panel is used, there may cause a fault in electron beam landing characteristics and a stable colored picture can not be obtained.

In accordance with the present invention, the deformation of the panel face portion due to the shrinkage of the skirt portion of the glass panel can be minimized.

In the present invention, a physically strengthening method is used to obtain a stable compressive stress by controlling a cooling speed and temperature at the time of the slow-cooling of the glass bulb after it has been shaped. The conventional ion exchange strengthening method wherein a large compressive stress is obtainable but a sufficient thickness of the compression layer is not obtained, or the conventional air cooling strengthening method wherein an excessive tensile strength is resulted inside the glass bulb to thereby cause the implosion of the cathode ray tube, or when the tensile stress inside the glass bulb is reduced, a stable compressive stress is not obtainable, are not used in the present invention.

The inventors of this application realize through experiments a glass bulb which has a wall thickness thinner than that of the conventional glass bulb by specifying the magnitude of the compressive stress and which is free from an implosion and reduces the weight of the glass bulb.

The shape of the panel face portion may be spherical, cylindrical or non-spherical. However, the present invention is more suitable for a panel or a high definition TV which has a large aspect ratio and a non-spherical surface.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
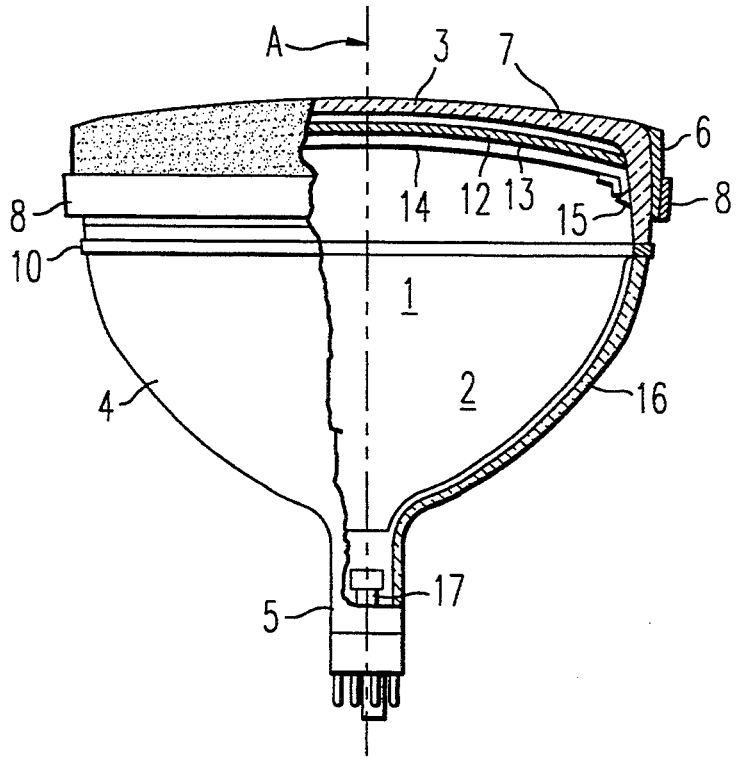
FIG. 1 is a front view partly cross-sectioned of a cathode ray tube for TV to explain a glass bulb in accordance with the present invention.
Figure 2:
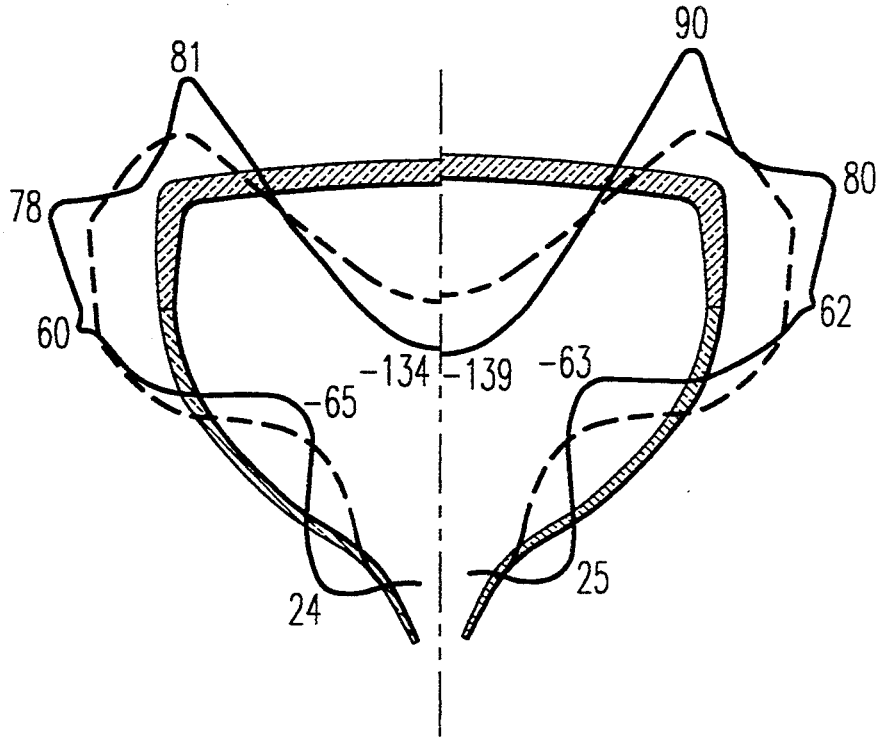
FIG. 2 is a diagram showing distribution of stresses generated in a glass bulb for a conventional 28-inch type cathode ray tube.
Figure 3:
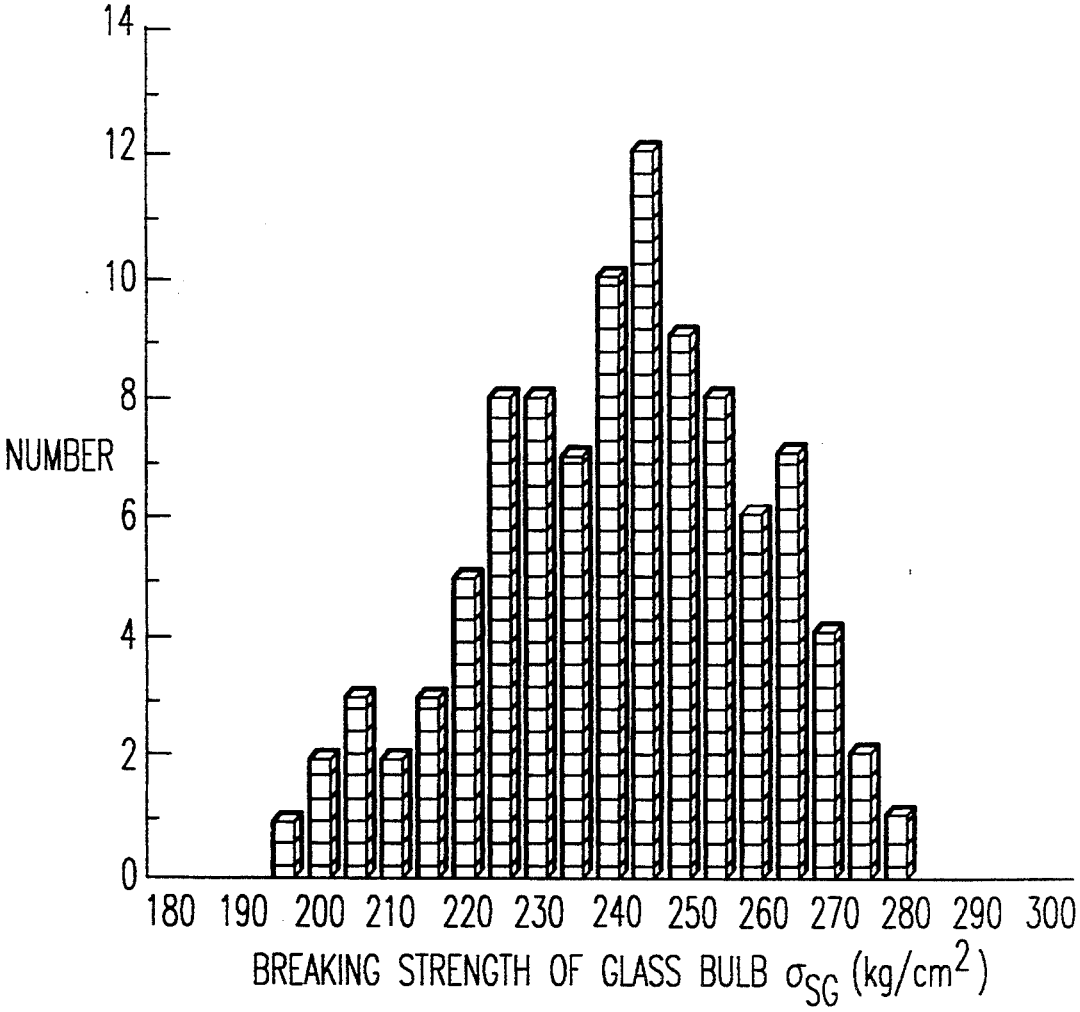
FIG. 3 is a graph showing the fracture strength of conventional glass bulbs for cathode ray tubes.

When a glass bulb is rapidly cooled from a high temperature region near the glass softening point, the surface of the glass is rapidly shrinked and solidified. However, the inside of the glass is in a state having a sufficient fluidity and expansion, and a temporal distortion is instantaneously released by the fluidity. When the glass bulb is further cooled, the inside of the glass tends to shrink. However, the movement of the shrinkage is limited by the presence of the solidified surface layer. As a result, when the temperature of the glass decreases to the room temperature to reach a sufficient equilibrium state, a layer having a large compressive stress is formed in the surface portion of the glass and a layer having a tensile stress is formed inside the glass as residual stresses. In this case, the magnitude of the stresses produced in the glass depends on a time required when the temperature at the surface of the glass decreases from a slow cooling temperature to the distortion point. As the cooling time is short, a large difference of shrinkage between the surface portion and the inside of the glass is obtained, and a compressive stress $\sigma_{KC}$ having a large absolute value is produced in the surface portion after the cooling. In this case, a tensile stress of a magnitude of $\sigma_{KT}=-\sigma_{KC}/2$ is naturally produced inside the glass bulb so that the compressive stress is cancelled. Thus, the compressive stress layer produced in the surface portion increases the strength of the glass bulb. However, when there is a crack penetrating the compressive stress layer, the crack will develop to release a distortion energy stored in the tensile stress layer formed inside the glass bulb to thereby possibly cause the implosion of the cathode ray tube. Accordingly, to simply increase the compressive stress $\sigma_{KC}$ and the tensile stress $\sigma_{KT}$ will create a problem.

For a cathode ray tube for receiving TV signals, which has the largest diameter of 15 cm or more, generally, the outer surface of the skirt portion of the panel portion is fastened with a metallic implosion-proof band. The band eliminates a danger of the breakage of the cathode ray tube even when an impact having a magnitude considered in common-sense is applied to the cathode ray tube.

Further, even when the breakage of the glass bulb for a cathode ray tube takes place due to a strong impact applied thereto, a user has to be kept safely. In the UL safety standards (No. 1418, the 3rd edition) in U.S.A., there are described two kinds of method as standards of safety. Namely, when cathode ray tubes are forcibly broken, determination of safety is made depending on an amount of pieces of glass scattered by the breakage of the tube.

In one of the methods, two scratches each having a length of 10 cm are formed at upper and lower portions on a longer side near an edge portion of the effective picture displaying portion of the panel face portion with a diamond cutter, and then, the panel face portion is hit with a missile-like material made of steel so that energy of 20 Joules or less is given to the scratched portion so as to break the cathode ray tube. The quality of the cathode ray tube is judged depending on the size of the glass pieces scattered. The method is called a missile method.

In another method, a steel rod of a diameter of 25 mm is disposed perpendicular to and near the sealing portion of the glass bulb for sealing the panel to the funnel portion, and a weight of 4.5 kg or more is dropped on the steel rod so as to hit with an energy of 7 Joules or more the funnel portion which is 3 mm behind the sealing portion which seals the panel and the funnel portion whereby the cathode ray tube is forcibly broken. The quality of the cathode ray tube is judged depending on the size of glass pieces scattered. The method is called a guillotine method.

In these forced breakage tests, when an abrupt implosion takes place, an amount of glass pieces scattered is large. In this case, there is a high possibility of failure.

In the present invention, a permissible range of $\sigma_{KT}$ was obtained by detecting the presence or absence of the occurrence of implosion by using these tests in order to confirm whether or not the presence of a physically strengthened stress layer provides safety. Table 1 shows the depth of scratches produced by scratching a panel glass with various types of scratching tool. In a case of the missile method, the depth of a scratch with use of a diamond cutter was at most 140 μm. On the other hand, the thickness of the compression layer was about 1/6 as much as the thickness of the glass bulb. Accordingly, the thickness of the compression layer was sufficiently thicker than the depth of the scratch. There was found that as the absolute value of the compressive stress $\sigma_{KC}$ was larger, the development of the scratch could be prohibited.

TABLE 1

| Tool for scratching | Average depth | Max. depth |
|---|---|---|
| #400 emery paper | 10 μm | 12 μm |
| #150 emery paper | 21 | 30 |
| Cutter knife | 30 | 56 |
| Diamond cutter | 115 | 140 |

On the other hand, in the guillotine method, a crack extending from the position of impact in the funnel portion was developed to the funnel portion, i.e. the crack penetrated the compressive stress layer to reach the tensile stress layer. Accordingly, as the tensile stress $\sigma_{KT}$ is larger, the development of the crack is accelerated, whereby the incident of implosion is increased. For instance, when the value of the tensile stress $\sigma_{KT}$ inside the glass bulb exceeded $\sigma_{SG}/2$, there took place nearly the implosion of 100% and it is very dangerous. Even when the value was about $\sigma_{SG}/3$, implosion occurred in some cases. A range of $\sigma_{KT}$ which did not cause the implosion was $\sigma_{SG}/4$ or less in the same manner as a case of non-strengthened stress layer. Accordingly, from the relation of $\sigma_{KT}=-\sigma_{KC}/2$, it was found that the compressive stress in the surface portion should be in a range of $-\sigma_{KC}\leqq\sigma_{SG}/2$.

When the glass bulb having such compressive stress layer is assembled to form a cathode ray tube and the inside of the glass bulb is vacuumed, a stress $\sigma$ produced in the outer surface of the glass bulb can be expressed by the sum of a vacuum stress $\sigma_V$ and a surface compressive stress $\sigma_{KC}$, i.e. $\sigma=\sigma_V+\sigma_{KC}$ by the application of the stress overlapping principle on a linear elastic material.

In order not to cause the breakage of the cathode ray tube during the manufacture and the use, the glass bulb has to be withstand a pressure difference of 3 atm. pressure between the inside and the outside of the glass bulb during the above-mentioned tests for pressure resistance strength. When the pressure difference of 3 atm. pressure is given to the glass bulb, the magnitude of the stress produced in the surface portion of the glass bulb will become $\sigma=3.0\sigma_V+\sigma_{KC}$. Accordingly, the condition free from breakage is expressed by $3.0\sigma_{VTmax}+\sigma_{KC}<\sigma_{SG}$ where $\sigma_{SG}$ is the fracture strength of the glass bulb derived from the structure and $\sigma_{VTmax}$ is the maximum tensile vacuum stress in the atmospheric pressure. When the above-mentioned relation $-\sigma_{KC}\leqq\frac{1}{2}\sigma_{SG}$ is used, $\sigma_{KC}$ should be in a range of $\sigma_{VTmax}<\frac{1}{3}(\sigma_{SG}-\sigma_{KC})\leqq\frac{1}{2}\sigma_{SG}$.

On the other hand, the wall thickness of the glass bulb has to be reduced to thereby reduce the weight by using a physically strengthening method. Accordingly, the condition of $\sigma_{SG}/3<\sigma_{VTmax}$ has to be satisfied. As a result, $\frac{1}{3}\sigma_{SG}<\sigma_{VTmax}<(\sigma_{SG}-\sigma_{KC})/3\leqq\sigma_{SG}/2$ is given. Namely, $\sigma_{VTmax}$ and $\sigma_{KC}$ have to be satisfy the relation of $1<3\sigma_{VTmax}/\sigma_{SG}<1-\sigma_{KC}/\sigma_{SG}\leqq 3/2$ in order to assure the safety and to reduce the weight while a physically strengthened layer is formed.

In manufacturing a cathode ray tube for color TV, the strength of the sealing region between the panel and the funnel has to be increased. For this purpose, a $PbO—B_2O_3—ZnO—BaO—SiO_2$ series crystalline solder glass (ASF1307 manufactured by Asahi Glass Company Ltd.) is used to seal the sealing portion, and the sealing portion is baked at about 440° C. for 35 min. to thereby obtain an integrally shaped glass bulb. The bending strength of the baked solder glass is only about 70% of the bending strength of the funnel glass or solder glass. In order to prevent the breakage of the sealing portion, the wall thickness of the panel portion and the funnel portion near the sealing portion is increased and the vacuum tensile stress produced in the sealing portion is controlled to be about 60 kg/cm$^2$.

When the crystalline solder glass is used for the sealing portion to seal the glass bulb, the glass bulb is baked at about 440° C. for 35 min, and the glass bulb is cooled to the room temperature in manufacturing a cathode ray tube for color TV, the compressive stress produced in the panel glass is reduced by about 5%. In the present invention, since the compressive stress is formed in consideration of an amount of reducing the compressive stress, a sufficient compressive stress is left to strengthen the panel glass even after the cathode ray tube for color TV has been manufactured by sealing the panel glass and the funnel glass.

The weight of the panel portion can be reduced by reducing the wall thickness of the panel face portion or the side wall portion of the panel (skirt portion). When the wall thickness of the side wall portion of the panel is reduced, the tensile vacuum stress in the sealing portion between the panel and the funnel will increase, and there is a problem of the breakage of the panel at the sealing portion. Namely, it is preferable to reduce the wall thickness of the panel face portion.

The wall thickness of the panel face portion can be reduced by moving in parallel either of the outer curved surface and the inner curved surface of the panel face portion while the radius of curvature of the outer and the inner curved surface is unchanged.

The maximum tensile vacuum stress $\sigma_{VTmax}$ produced near an edge portion of the picture displaying portion of the panel face on a shorter axis or a longer axis of a glass bulb for a cathode ray tube having an aspect ratio of 4:3 or 16:9 is in inverse proportion to about second power of the wall thickness of the central portion of the panel face portion. Accordingly, when the wall thickness of the central portion of the panel face portion which satisfies $\sigma_{VTmax}=\sigma_{SG}/3$ is $t_0$, the maximum tensile vacuum stress of the glass bulb wherein the wall thickness is $t_1$ is in a relation of $\sigma_{VTmax}=(t_0/t_1)^2\sigma_{SG}/3$.

As described before, since a permissible range of $\sigma_{VTmax}$ for the glass bulb having a physically strengthened compressive stress layer $\sigma_{KC}$ is $\sigma_{SG}/3<\sigma_{VTmax}<(\sigma_{SG}-\sigma_{KC})/3$, there is $\sigma_{SG}/(\sigma_{SG}-\sigma_{KC})<(t_1/t_0)^2<1$. Namely, the reduction of the weight of the cathode ray tube without causing an implosion can be achieved by reducing the wall thickness $t_1$ of the central portion of the panel face portion within the above-mentioned range.

In the following, preferred examples will be described. However, the present invention should not be limited to the Examples.

EXAMPLE 1

Glass bulbs were prepared by using glass materials having physical properties as shown in Table 2 and having compositions described in Table 3. The glass bulbs were the same as those for ordinary cathode ray tubes for color TV as shown in FIG. 1. Description of each element in FIG. 1 is omitted except for the distribution of stresses and a reduced thickness of the panel face portion 7 because the elements are the same as those of the conventional glass bulb. In Table 2 and Table 3, a title indicates tradenames of glass products manufactured by Asahi Glass Company Ltd.

Each of the glass bulbs had the same shape and the same dimensions as a conventional glass bulb for a 29-inch type TV which has an aspect ratio of 4:3 and an effective picture area of a diagonal line of 68 cm. In this example, the wall thickness of the panel face portion was reduced by moving the inner curved surface of the panel face portion outwardly and in parallel to the tube axis which passes through the center of the panel face portion and the center of the neck portion, whereby the wall thickness of the central portion of the panel face was reduced from 14 mm (conventional product) to 13 mm.

TABLE 2

| | Panel glass | Funnel glass | Neck glass |
|---|---|---|---|
| Title (tradename) | 5008 | 0138 | 0150 |
| Density (g/cm$^3$) | 2.79 | 3.00 | 3.29 |
| Young's modulus (kg/cm$^2$) | $7.5\times10^5$ | $6.9\times10^5$ | $6.2\times10^5$ |
| Poisson ratio | 0.21 | 0.21 | 0.23 |
| Softening point (°C.) | 703 | 663 | 643 |
| Annealing point (°C.) | 521 | 491 | 466 |
| Distortion point (°C.) | 477 | 453 | 428 |

TABLE 3

| | Panel glass | Funnel glass | Neck glass |
|---|---|---|---|
| Title | 5008 | 0138 | 0150 |
| $SiO_2$ | 60.5 | 52.0 | 47.5 |
| SrO | 8.0 | — | 2.0 |
| BaO | 9.0 | — | — |
| PbO | — | 22.0 | 32.5 |
| $Al_2O_3$ | 3.0 | 5.0 | 3.5 |
| CaO | 3.0 | 5.0 | — |
| $Na_2O$ | 8.0 | 8.0 | 4.5 |
| $K_2O$ | 8.5 | 8.0 | 10.0 |

The inside of the glass bulbs was evacuated in vacuum, the maximum tensile vacuum stress $\sigma_{VTmax}$ on the shorter axis of an edge portion of the effective picture displaying portion of the outer surface of the panel face portion was obtained Each of the values is shown in Table 4.

TABLE 4

(Rate of implosion in tests of pressure resistance strength and implosion-proof of glass bulbs for a 29-inch type TV (aspect ratio of 4:3)

| | Wall thickness at the central portion of panel face (mm) | Maximum tensile vacuum stress ($\sigma_{VTmax}$) (kg/cm$^2$) | Strengthened stress $\sigma_{KT}$ (kg/cm$^2$) | $\sigma_{KC}$ (kg/cm$^2$) | $\frac{1}{3}(\sigma_{SG}-\sigma_{KC})$ (kg/cm$^2$) | Pressure resistance strength P | Missile test Incidence of implosion | Guillotine test Incidence of implosion |
|---|---|---|---|---|---|---|---|---|
| Case 1 | 14.0 | 84 | 0 | 0 | 83 | 3.0 | 0/10 | 0/10 |
| Case 2 | 13.0 | 97 | 0 | 0 | 83 | 2.6 | 0/10 | 0/10 |
| Case 3 | 13.0 | 97 | 15 | −31 | 94 | 2.9 | 0/10 | 0/10 |
| Case 4 | 13.0 | 97 | 41 | −82 | 111 | 3.4 | 0/10 | 0/10 |
| Case 5 | 13.0 | 97 | 64 | −129 | 126 | 3.9 | 0/10 | 0/10 |
| Case 6 | 13.0 | 97 | 81 | −163 | 137 | 4.3 | 0/10 | 2/10 |
| Case 7 | 13.0 | 97 | 129 | −260 | 170 | 5.0 | 0/10 | 9/10 |

As clearly shown in Table 4, the maximum tensile vacuum stress $\sigma_{VTmax}$ assumed 97 kg/cm$^2$ when the wall thickness of the central portion of the panel face portion was reduced to 13 mm. On the other hand, the maximum tensile vacuum stress was 84 kg/cm$^2$ in the conventional product in which the wall thickness of the central portion of the panel face portion was 14 mm.

Next, compressive stress layers having various values of $\sigma_{KC}$ were formed substantially uniformly in the outer surface and the inner surface of the panel portion by manipulating a cooling speed and temperature during slow-cooling of thin-walled panels after the shaping. These values of $\sigma_{KC}$ are shown in a case No. 3 through a case No. 7 in Table 4.

To confirm the relation between the compressive stress value $\sigma_{KC}$ formed in the surface portion of the panel and the strength of the panel, tests for pressure resistance strength and implosion-proof treatment were conducted after the strengthened panel and the funnel were sealed to form each glass bulb. Evaluation was made by implosion-proof tests by using the missile method and the guillotine method.

In a case of the conventional glass bulb using a panel in which the wall thickness of the central portion of the panel face portion was 14 mm, the pressure resistance strength was about 3.0 kg/cm$^2$. On the other hand, when a non-strengthened glass bulb having a panel in which the wall thickness of the central portion of the panel face portion was reduced to 13 mm, the pressure resistance strength was reduced to 2.6 kg/cm$^2$. In obtaining the fracture strength $\sigma_{SG}$ of both the glass bulbs, about 250 kg/cm$^2$ was obtained.

The pressure resistance strength was measured on strengthened glass bulbs having a reduced wall thickness. As shown in Table 4, a relation of $\sigma_{SG}=P\cdot\sigma_{VT}+\sigma_{KC}$ was established. It was found that as the absolute value of the compressive stress increased, the value of pressure resistance strength P became large. However, in the case No. 3 which did not satisfy the relation $\sigma_{VTmax}<(\sigma_{SG}-\sigma_{KC})/3$, the pressure resistance strength was 2.9 kg/cm$^2$ which could not guarantee 3.0 kg/cm$^2$.

Then, the missile tests were conducted to obtain a rate of implosion. As a result, it was found that the rate of implosion was not increased as the absolute value of the compressive stress became large, and a scratch which was previously formed in an edge portion of the effective surface area of the panel face portion prevented the development of a scratch.

Further, the guillotine tests were conducted to obtain a rate of implosion in the same manner as the missile tests. As a result, the rate of implosion was increased as seen in the case No. 6 and the case No. 7 as the compressive stress $\sigma_{KC}$ or the tensile stress $\sigma_{KT}$ was increased. It was because when a crack produced in the funnel portion at a point where an impulse was applied by means of a steel rod extended to the panel portion, and the crack penetrates the compressive stress layer in the direction of the wall thickness to reach the tensile stress layer, the development of the crack was accelerated in order to release a stored energy accumulated by a strengthening treatment. In obtaining a range of the value $\sigma_{KT}$ or the value $\sigma_{KC}$ which prevents the occurrence of the implosion, it was revealed that $\sigma_{KT}\leqq\sigma_{SG}/4$ i.e. $-\sigma_{KC}\leqq\sigma_{SG}/2$ was sufficient from the values in Table 4.

EXAMPLE 2

Glass bulbs for 28-inch lateral type TVs having an aspect ratio of 16.9 and an effective displaying area of a diagonal line of 66 cm were prepared. The same evaluation as Example 1 was conducted to observe influences effected by the structural factors of the glass bulbs. The wall thickness of the central portion of a conventional panel face portion for a 28-inch TV was 13.5 mm. The wall thickness of the central portion of the panel faces having a thin wall thickness was 12.5 mm.

It was confirmed that the maximum tensile vacuum stress $\sigma_{VTmax}$ was formed in an edge portion on a shorter axis of the effective displaying area of the outer surface of the panel face portion. Pressure resistance strength tests were conducted to the glass bulbs. In the fracture strength $\sigma_{SG}$, there was obtained about 250 kg/cm$^2$. The compressive stress values $\sigma_{KC}$ in the surface portion of the strengthened panel face portion are shown in the case No. 3 to the case No. 5 in Table 5.

TABLE 5

(Rate of implosion in tests of pressure resistance strength and implosion-proof of glass bulbs for a 28-inch type TV (aspect ratio of 16:9)

| | Wall thickness at the central portion of panel face (mm) | Maximum tensile vacuum stress ($\sigma_{VTmax}$) (kg/cm$^2$) | Strengthened stress $\sigma_{KT}$ (kg/cm$^2$) | $\sigma_{KC}$ (kg/cm$^2$) | $\frac{1}{3}(\sigma_{SG}-\sigma_{KC})$ (kg/cm$^2$) | Pressure resistance strength P | Missile test Incidence of implosion | Guillotine test Incidence of implosion |
|---|---|---|---|---|---|---|---|---|
| Case 1 | 13.5 | 81 | 0 | 0 | 83 | 3.1 | 0/10 | 0/10 |
| Case 2 | 12.5 | 97 | 0 | 0 | 83 | 2.6 | 1/10 | 0/10 |
| Case 3 | 12.5 | 97 | 13 | −27 | 92 | 2.9 | 1/10 | 0/10 |
| Case 4 | 12.5 | 97 | 59 | −119 | 123 | 3.8 | 0/10 | 0/10 |
| Case 5 | 12.5 | 97 | 72 | −145 | 132 | 4.1 | 0/10 | 2/10 |

The pressure resistance strength on the case No. 2 and the case No. 3 wherein the maximum tensile vacuum stress $\sigma_{VTmax}$ was larger than $(\sigma_{SG}-\sigma_{KC})/3$ in the thin-walled glass bulbs, was less than 3.0 kg/cm$^2$, which was insufficient. Further, it was revealed that there were found some implosion as a result of the missile tests, and there rised a problem of safety.

On the other hand, on the case No. 4 and the case No. 5 which had an increased absolute value of the compressive stress $\sigma_{KC}$ and satisfied $\sigma_{VTmax}<(\sigma_{SG}-\sigma_{KC})/3$, the pressure resistance strength exceeded 3.0 kg/cm$^2$, and there was no incidence of implosion in the missile tests due to the presence of the compressive stress layer for preventing the development of cracks. In the guillotine tests, no implosion occurred on the case No. 4 which satisfied $\sigma_{KT}<\sigma_{SG}/4$. On the other hand, an implosion occurred on the case No. 5 wherein $\sigma_{KT}>4\sigma_{SG}/4$. From these tests, it was confirmed that $\sigma_{VTmax}$ and $\sigma_{KC}$ should have relations $\sigma_{VTmax}<(\sigma_{SG}-\sigma_{KC})/3$ and $-\sigma_{KC}\leqq\sigma_{SG}/2$ to guarantee the strength as in the case No. 4.

EXAMPLE 3

Panel glasses for a 29-inch type TV having an aspect ratio of 4:3 and an effective displaying area of a diagonal line of 68 cm were prepared in the same manner as Example 1 except that the compressive stress $\sigma_{KC}$ (kg/cm$^2$) in the outer surface of the panel face portion was larger than that of the skirt portion as shown in Table 6. When the panel glasses were cooled from the slow cooling point to the distortion point, cooling air was mainly direct to the panel face portion so that the panel face portion was rapidly cooled in comparison with the skirt portion.

TABLE 6

| | Sample 1 | Sample 2 | Sample 3 | Sample 4 |
|---|---|---|---|---|
| Face portion | 124 | 112 | 87 | 127 |
| Skirt portion | 231 | 70 | 51 | 74 |

In sample No. 1, the compressive stress of the skirt portion was larger than that of the panel face portion.

In sample Nos. 2 to 4, the compressive stress of the skirt portion was respectively 62%, 60% and 58% of the compressive stress of the face portion. An amount of twisting (μm) after cooling was measured for each sample of panels, each sample consisting of 100 number of panels. The measurement was conducted by measuring the difference of height, at the central portion of the panel from the panel face, on two diagonal lines connecting four corners of the panel. In sample No. 1, the amount of twisting was about 100 μm in average, and in sample Nos. 2–4, the amount of twisting could be reduced to one fourth of the sample No. 1.

In accordance with the present invention, a physically strengthened layer which provides a stable compressive stress can be obtained by manipulating a cooling speed and temperature during the slowly cooling a glass bulb for a cathode ray tube after the glass bulb has been shaped. Further, the magnitude of the compressive stress is determined in a permissible range. Accordingly, there is obtainable the glass bulb having a thinner wall thickness than a conventional glass bulb, free from an implosion, and capable of reducing the weight. In addition, the wall thickness of the panel face portion is reduced to thereby reduce the weight.

Obviously, numerous modifications and variations of the present invention are possible in light of the above teachings. It is therefore to be understood that within the scope of the appended claims, the invention may be practiced otherwise than as specifically described herein.

What is claimed is:

1. A glass bulb for a cathode ray tube which comprises:

a panel portion having a substantially rectangular panel face portion; a funnel portion, and a neck portion, wherein a physically strengthened compression layer having a compressive stress $\sigma_{KC}$ is formed in at least the panel portion of the glass bulb, and the compressive stress $\sigma_{KC}$ has a relation of $1<3\sigma_{VTmax}/\sigma_{SG}1-(\sigma_{KC}/\sigma_{SG})\leqq1.60$ to the fracture strength $\sigma_{SG}$ of the glass bulb and the maximum tensile vacuum stress $\sigma_{VTmax}$ which is the maximum value of tensile stress generated in the surface of the glass bulb vacuumed onto which an atmospheric pressure is applied.

2. The glass bulb for a cathode ray tube according to claim 1, wherein there is a relation of $1<3\sigma_{VTmax}/\sigma_{SG}\leqq1(\sigma_{KC}/\sigma_{SG})\leqq1.50$ among the compressive stress $\sigma_{KC}$, the fracture strength $\sigma_{SG}$ of the glass bulb and the maximum tensile vacuum stress $\sigma_{VTmax}$.

3. The glass bulb for a cathode ray tube according to claim 1, wherein the compressive stress $\sigma_{KC}$ is in a range of from −150 kg/cm$^2$ to −30 kg/cm$^2$.

4. The glass bulb for a cathode ray tube according to claim 1, wherein the maximum value $\sigma_{VTmax}$ of the tensile stress is in a range of from 70 kg/cm$^2$ to 100 kg/cm$^2$.

5. The glass bulb for a cathode ray tube according to claim 1, wherein the maximum value $\sigma_{VTmax}$ of the tensile stress exists in an edge portion on a shorter axis or a longer axis of the outer surface of the face portion.

6. The glass bulb for a cathode ray tube according to claim 1, wherein the compressive stress $\sigma_{KC}$ in the panel face portion is larger than that in a skirt portion of the panel portion.

7. The glass bulb for a cathode ray tube according to claim 6, wherein cooling air is supplied mainly to the panel face portion of the panel portion while temperature at the front surface of the panel portion decreases from the slow-cooling point to the distortion point, whereby the panel face portion is rapidly cooled in comparison with the skirt portion of the panel portion.

8. The glass bulb for a cathode ray tube according to claim 6, wherein the compressive stress $\sigma_{KC}$ of the skirt portion is in a range of from 50% to less than 100% of the compressive stress $\sigma_{KC}$ Of the panel face portion.

9. The glass bulb for a cathode ray tube according to claim 8, wherein the compressive stress $\sigma_{KC}$ of the skirt portion is in a range of from 60% to 90% of the compressive stress $\sigma_{KC}$ of the panel face portion.

10. The glass bulb for a cathode ray tube according to claim 1, wherein cooling air is supplied mainly to the panel face portion of the panel portion while temperature at the front surface of the panel portion decreases from the slow-cooling point to the distortion point.

11. A glass bulb for a cathode ray tube which comprises:

a panel portion having a substantially rectangular panel face portion; a funnel portion, and a neck portion, wherein a physically strengthened compression layer having a compressive stress $\sigma_{KC}$ is formed in at least the panel portion of the glass bulb, and the compressive stress $\sigma_{KC}$ has a relation of $1<3\sigma_{VTmax}/\sigma_{SG}\leqq 1-(\sigma_{KC}/\sigma_{SG})$ and $-150$ kg/cm$^2\leqq\sigma_{KC}-30$ kg/cm$^2$ to the fracture strength $\sigma_{SG}$ of the glass bulb and the maximum tensile vacuum stress $\sigma_{VTmax}$ which is the maximum value of tensile stress generated in the surface of the glass bulb vacuumed onto which an atmospheric pressure is applied.

12. The glass bulb for a cathode ray tube according to claim 11, wherein the maximum value $\sigma_{VTmax}$ of the tensile stress exists in an edge portion on a shorter axis of the outer surface of the face portion.

13. The glass bulb for a cathode ray tube according to claim 11, wherein the compressive stress $\sigma_{KC}$ in the panel face portion is larger than that in a skirt portion of the panel portion.

14. The glass bulb for a cathode ray tube according to claim 13, wherein the compressive stress $\sigma_{KC}$ of the skirt portion is in a range of from 50% to less than 100% of the compressive stress $\sigma_{KC}$ of the panel face portion.

15. The glass bulb for a cathode ray tube according to claim 14, wherein the compressive stress $\sigma_{KC}$ of the skirt portion is in a range of from 60% to 90% of the compressive stress $\sigma_{KC}$ of the panel face portion.

16. A glass bulb for a cathode ray tube which comprises:

a panel portion having a substantially rectangular panel face portion; a funnel portion, and a neck portion, wherein a physically strengthened compression layer having a compressive stress $\sigma_{KC}$ is formed in a portion where the maximum vacuum stress is produced, in the panel portion of the glass bulb, and the compressive stress $\sigma_{KC}$ has a relation of $1<3\sigma_{VTmax}/\sigma_{SG}1-(\sigma_{KC}/\sigma_{SG})1.60$ to the fracture strength $\sigma_{SG}$ of the glass bulb and the maximum tensile vacuum stress $\sigma_{VTmax}$ which is the maximum value of tensile stress generated in the surface of the glass bulb vacuumed onto which an atmospheric pressure is applied.

17. The glass bulb for a cathode ray tube according to claim 16, wherein there is a relation of $1<3\sigma_{VTmax}/\sigma_{SG}\leqq 1-(\sigma_{KC}/\sigma_{SG})\leqq 1.50$ among the compressive stress $\sigma_{KC}$, the fracture strength $\sigma_{SG}$ of the glass bulb and the maximum tensile vacuum stress $\sigma_{VTmax}$.

18. The glass bulb for a cathode ray tube according to claim 16, wherein the compressive stress $\sigma_{KC}$ is in a range of from $-150$ kg/cm$^2$ to $-30$ kg/cm$^2$.

19. The glass bulb for a cathode ray tube according to claim 16, wherein the maximum value $\sigma_{VTmax}$ of the tensile stress exists in an edge portion on a shorter axis or a longer axis of the outer surface of the face portion.

20. The glass bulb for a cathode ray tube according to claim 16, wherein the maximum tensile vacuum stress $\sigma_{VTmax}$ is produced in an edge portion of the outer surface of the panel face portion of the panel portion.

21. The glass bulb for a cathode ray tube according to claim 20, wherein the compressive stress $\sigma_{KC}$ of the skirt portion is in a range of from 50% to less than 100% of the compressive stress $\sigma_{KC}$ of the panel face portion.

22. The glass bulb for a cathode ray tube according to claim 16, wherein the maximum tensile vacuum stress $\sigma_{VTmax}$ is produced in the outer surface of the skirt portion of the panel portion.

23. The glass bulb for a cathode ray tube according to claim 16, wherein the maximum tensile vacuum stress $\sigma_{VTmax}$ exists in an edge portion of a picture image display surface of the panel portion, and there is a relation of $\sigma_{SG}/(\sigma_{SG}-\sigma_{KC})\leqq(t_1/t_0)^2<1$ where $t_1$ is the wall thickness of the central portion of the panel face portion and $t_0$ is the wall thickness of the central portion of the panel face portion under the condition that when the shapes of the inside and the outside of the panel face portion are constant and the wall thickness of the panel face portion is changed to be $\sigma_{VTmax}=\sigma_{SG}/3$.

24. The glass bulb for a cathode ray tube according to claim 23, wherein the compressive stress $\sigma_{KC}$ is in a range of from $-150$ kg/cm$^2$ to $-30$ kg/cm$^2$.

25. The glass bulb for a cathode ray tube according to claim 23, wherein the compressive stress $\sigma_{KC}$ in the panel face portion is larger than that in a skirt portion of the panel portion.

26. The glass bulb for a cathode ray tube according to claim 23, wherein the compressive stress $\sigma_{KC}$ of the skirt portion is in a range of from 50% to less than 100% of the compressive stress $\sigma_{KC}$ of the panel face portion.

27. The glass bulb for a cathode ray tube according to claim 23, wherein the maximum value $\sigma_{VTmax}$ of the tensile stress exists in an edge portion on a shorter axis or a longer axis of the outer surface of the face portion.

28. The glass bulb for a cathode ray tube according to claim 23, wherein there is a relation of $0.64\leqq(t_1/t_2)^2<1$.

29. The glass bulb for a cathode ray tube according to claim 23, wherein there is a relation of $0.72\leqq(t_1/t_0)^2\leqq 0.9$.

* * * * *

UNITED STATES PATENT AND TRADEMARK OFFICE

CERTIFICATE OF CORRECTION

PATENT NO. : 5,445,285
DATED : August 29, 1995
INVENTOR(S) : Yusuke Kobayashi et al.

It is certified that error appears in the above-identified patent and that said Letters Patent is hereby corrected as shown below:

Column 4,
Line 1, insert -- , -- after "kg/cm2";
Line 43, insert -- $\leqq$ -- after "$\sigma_{KC}$".

Column 5,
Line 53, "$|\sigma_{KC}|\sigma_{SG}/2$" should read -- $|\sigma_{KC}|\leqq\sigma_{SG}/2$ --.

Column 8,
Line 49, insert -- able to -- after the words "has to be";
Line 68, delete "be".

Column 14,
Line 47, "$1<3\sigma_{VTmax}/\sigma_{SG}1\text{-}(\sigma_{KC}/\sigma_{SG})\leqq1.60$" should read -- $1<3\sigma_{VTmax}/\sigma_{SG}\leqq1 -(\sigma_{KC}/\sigma_{SG})\leqq1.60$ --;
Line 55, "$1(\sigma_{KC/}\sigma_{SG})\leqq1.50$" should read -- $1 - (\sigma_{KC}/\sigma_{SG})\leqq1.50$ --.

Column 15,
Line 15, "Of" should read -- of --;
Line 34, "$kg/cm^2\leqq\sigma_{KC}\text{-}30\ kg/cm^2$" should read -- $kg/cm^2\leqq\sigma_{KC}\leqq\text{-}30\ kg/cm^2$ --.

Column 16,
Line 2, "$1<3\sigma_{VTmax}/\sigma_{SG}1- (\sigma_{KC}/\sigma_{SG})1.60$" should read -- $1<3\sigma_{VTmax}/\sigma_{SG}\leqq1- (\sigma_{KC}/\sigma_{SG})\leqq1.60$ --.

Signed and Sealed this

Thirtieth Day of July, 2002

*Attest:*

*Attesting Officer*

JAMES E. ROGAN
*Director of the United States Patent and Trademark Office*